US005503542A

United States Patent [19]

Grassbaugh et al.

[11] Patent Number: 5,503,542

[45] Date of Patent: Apr. 2, 1996

[54] COMPRESSOR ASSEMBLY WITH WELDED IPR VALVE

[75] Inventors: Walter T. Grassbaugh, Sidney; Jeffery D. Ramsey, Englewood, both of Ohio

[73] Assignee: Copeland Corporation, Sidney, Ohio

[21] Appl. No.: 372,593

[22] Filed: Jan. 13, 1995

[51] Int. Cl.[6] ..... F01C 1/04

[52] U.S. Cl. ..... 418/55.1; 417/310; 137/539.5

[58] Field of Search ..... 418/55.1; 417/310; 137/539.5

[56] References Cited

U.S. PATENT DOCUMENTS

| | | | |
|---|---|---|---|
| 1,623,316 | 4/1927 | Kinney . | |
| 1,769,153 | 7/1930 | Meyer . | |
| 3,207,179 | 9/1965 | Klagues | 137/539.5 |
| 3,233,822 | 2/1966 | Comstock et al. . | |
| 3,383,031 | 5/1968 | Ellis et al. . | |
| 3,509,907 | 5/1970 | Gannaway . | |
| 4,111,278 | 9/1978 | Bergman . | |
| 4,270,885 | 6/1981 | Shaffer et al. . | |
| 4,525,126 | 6/1985 | Laumont | 417/310 |
| 4,992,033 | 2/1991 | Caillat et al. . | |
| 5,055,010 | 10/1991 | Logan . | |
| 5,067,878 | 11/1991 | Da Costa . | |
| 5,101,931 | 4/1992 | Blass et al. . | |
| 5,151,420 | 8/1992 | Nambiar | 418/55.1 |
| 5,167,491 | 12/1992 | Keller, Jr. et al. . | |
| 5,176,506 | 1/1993 | Seibel . | |
| 5,267,844 | 12/1993 | Grassbaugh et al. | 418/55.1 |

FOREIGN PATENT DOCUMENTS

| | | | |
|---|---|---|---|
| 925590 | 5/1963 | United Kingdom | 137/539.5 |

*Primary Examiner*—Charles Freay
*Attorney, Agent, or Firm*—Harness, Dickey & Pierce

[57] ABSTRACT

A compressor has an hermetic shell within which is located an internal pressure relief (IPR) valve. The valve is resistance welded directly to a separation plate in a scroll compressor or directly to the outside wall of the discharge muffler in a piston/cylinder compressor. The direct welding of the IPR valve eliminates unnecessary components and lowers the manufacturing costs of the compressor.

19 Claims, 4 Drawing Sheets

COMPRESSOR ASSEMBLY WITH WELDED IPR VALVE

FIELD OF THE INVENTION

The present invention relates to hermetically sealed compressor assemblies. More particularly, the present invention relates to hermetically sealed compressor assemblies having a welded internal pressure relief (IPR) valve.

BACKGROUND OF THE INVENTION

Hermetically sealed motor compressors of various designs are well known in the art. These designs include both the piston/cylinder types and scroll types. The present invention applies equally well to all of the various designs of motor compressor units, and it will be described for exemplary purposes embodied in both a hermetically sealed scroll type fluid machine and a hermetically sealed piston/cylinder type fluid machine.

A scroll type fluid machine has a compressor section and an electrical motor section mounted in a hermetic shell with fluid passages being formed through the walls of the hermetic shell. The fluid passages are normally connected through pipes to external equipment such as, for example, an evaporator and condenser when the machine is used in a refrigeration system.

The scroll type compressor section has a compressor which is comprised of a non-orbiting scroll member which is mated with an orbiting scroll member. These scroll members have spiral wraps formed in conformity with a curve usually close to an involute curve so as to protrude upright from end plates. These scroll members are assembled together such that their wraps mesh with each other to form therebetween compression chambers. The volumes of these compression chambers are progressively changed in response to an orbital movement of the orbiting scroll member. A fluid suction port communicates with a portion of the non-orbiting scroll member near the radially outer end of the outermost compression chamber, while a fluid discharge port opens in the portion of the non-orbiting scroll member close to the center thereof. An Oldham's ring mechanism is placed between the orbiting scroll member and the non-orbiting scroll member so as to prevent the orbiting scroll member from rotating about its own axis.

The non-orbiting scroll member is secured to the main bearing housing by means of a plurality of bolts extending therebetween which allow limited relative axial movement between the bearing housing and the non-orbiting scroll member.

The orbiting scroll member is driven by a crankshaft so as to produce an orbiting movement with respect to the stationary scroll member. Consequently, the volumes of the previously mentioned chambers are progressively decreased to compress the fluid confined in these chambers, and the compressed fluid is discharged from the discharge port as the compression chambers are brought into communication with the discharge port.

A separation plate extends across the interior of the hermetic shell in order to divide the shell into a suction pressure zone and a discharge pressure zone. As a safety feature of the compressor, an IPR valve is indirectly attached to the separator plate by being threadingly received in a fitting which extends through the separation plate. The IPR valve will release discharge pressure to suction pressure when the discharge pressure exceeds a predetermined value.

A piston/cylinder type fluid machine has a compressor section and an electrical motor section mounted in a hermetic shell with fluid passages being formed through the walls of the hermetic shell. Similar to the scroll compressor described above, the fluid passages are normally connected through pipes to external equipment.

The piston/cylinder type fluid machine has a compressor which is comprised of a compressor body having one or more pistons mounted for reciprocal movement within cylinders extending through the compressor body. The piston moves from a lower position where fluid is allowed to enter the cylinder at a suction pressure to an upper position where the fluid within the cylinder its compressed between the piston and a cylinder head. The cylinder head normally includes one or more discharge valves which release the compressed fluid to the discharge pressure portion of the compressor.

The pistons are driven by a crankshaft so as to produce the reciprocating movement of the piston within the cylinder. Consequently, compressed fluid is delivered to the discharge pressure portion of the compressor with each movement of the piston between its lower and upper positions.

The interior of the hermetic shell for a piston/cylinder type fluid machine is normally at suction pressure. The compressor delivers compressed fluid to the discharge pressure portion of the compressor which normally includes a discharge conduit circuitously routed through the hermetic shell and a discharge muffler located within the hermetic shell at a location along the discharge conduit to facilitate the packaging of the system. As a safety feature of the compressor, an IPR valve is indirectly secured to the muffler by being threadingly received in a fitting which extends through the wall of the discharge muffler. The IPR valve will release discharge pressure to suction pressure within the hermetic shell when the discharge pressure exceeds a predetermined value.

While these prior art methods of indirectly attaching the IPR valve to a particular component have performed satisfactorily in the market, there is a never ending need to reduce the costs and complexities of the compressor assemblies.

Accordingly, what is needed is a means for directly fixedly attaching an IPR valve to either a separation plate in a scroll compressor or a discharge muffler in a piston/cylinder compressor. The attachment must be capable of withstanding the required pressures generated during the operation of the compressor while at the same time simplifying the assembly of the compressor and reducing the number of components required.

SUMMARY OF THE INVENTION

The present invention provides the art with a means for directly attaching an IPR valve to its appropriate member which is inexpensive, reliable and capable of meeting the required performance characteristics for the compressor. The IPR valve of the present invention is directly welded or brazed onto either the separation plate in a scroll compressor or the outside wall of the discharge muffler. The welding or brazing operation can be any of the various welding techniques used in the art including but not limited to resistance welding or capacitive discharge welding.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DESCRIPTION OF THE PREFERRED EMBODIMENTS

The present invention is illustrated for exemplary purposes in conjunction with both a hermetically sealed scroll compressor and a hermetically sealed piston/cylinder compressor. It is to be understood that the invention is not limited to a scroll compressor or a piston/cylinder compressor. It is possible to utilize the welded configuration for the IPR on virtually any type of motor compressor or similar machine.

Figure 1:
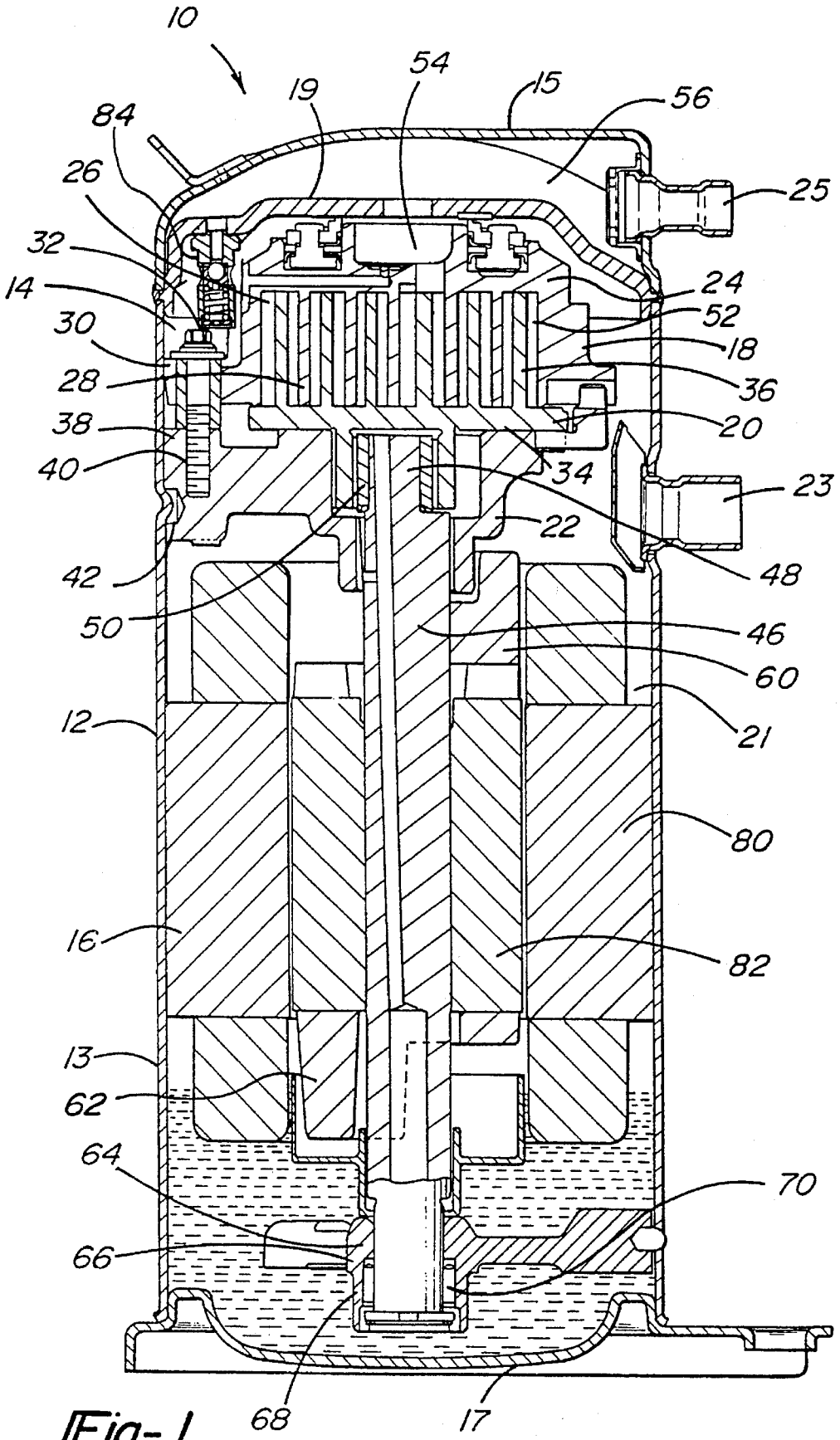
FIG. 1 is a side elevation, partially in cross section, of a hermetically sealed scroll compressor in accordance with the present invention.
Figure 2:
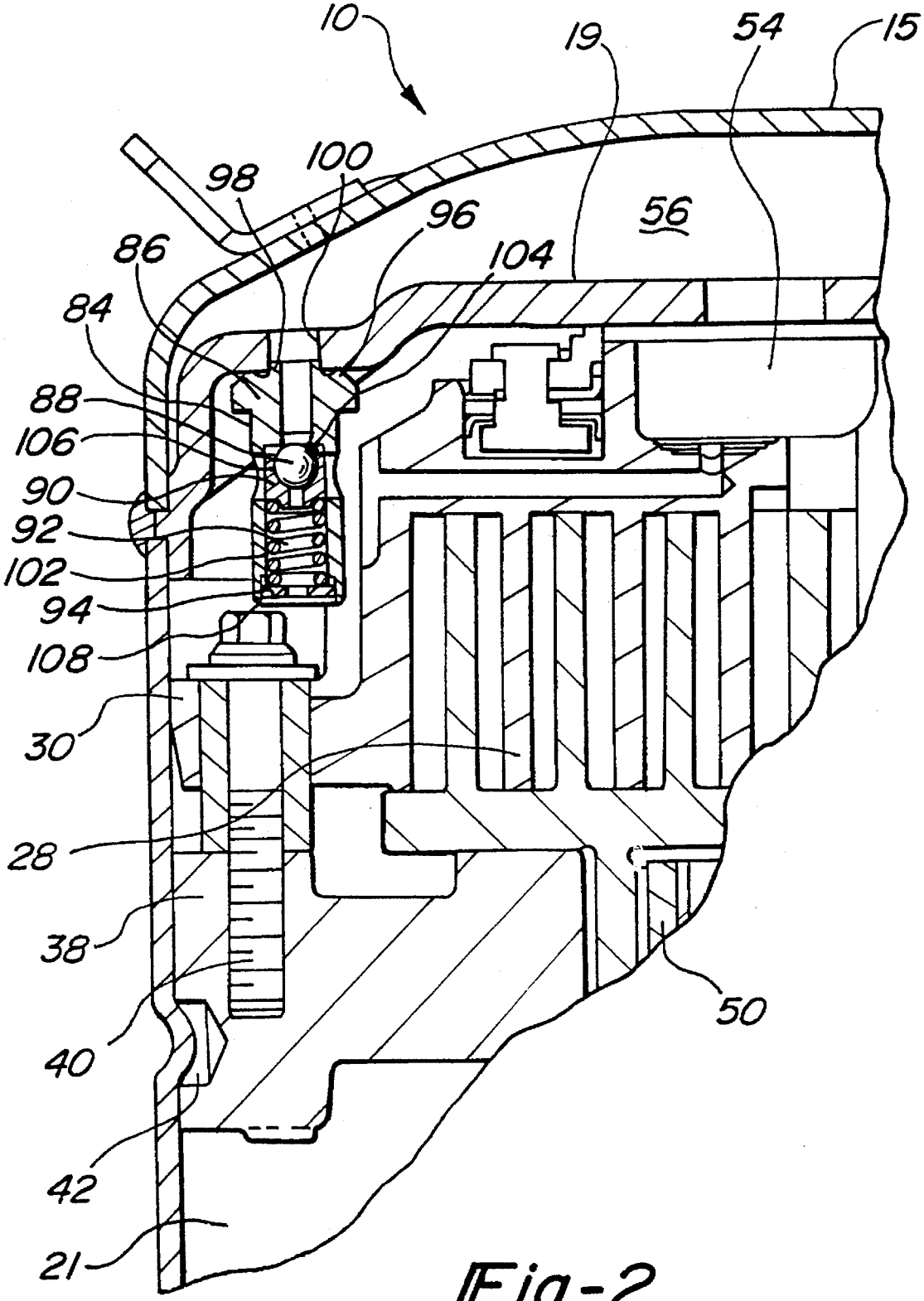
FIG. 2 is an enlarged view, partially in cross section, of the attachment of the IPR valve to the separation plate of the compressor shown in FIG. 1.

Referring to FIGS. 1 and 2, a scroll type fluid machine 10, in accordance with the present invention, which is in this case a compressor of a refrigeration system, is shown. Fluid machine 10 is comprised of a hermetic shell assembly 12, a compressor section 14 and a motor drive section 16. Hermetic shell assembly 12 is comprised of a lower shell 13, an upper cap 15, a bottom cover 17 and a separation plate 19. Bottom cover 17, lower shell 13, separation plate 19 and upper cap 15 are fixedly and sealingly attached in the manner shown by welding during assembly of fluid machine 10 to form a sealed suction chamber 21 and a discharge chamber 56. Hermetic shell 12 further has an inlet fitting 23 and an outlet fitting 25.

Compressor section 14 is comprised of a non-orbiting scroll member 18, an orbiting scroll member 20 and a bearing housing 22. Non-orbiting scroll member 18 is comprised of an end plate and body 24 having a chamber 26 in which is disposed a spiral wrap 28. Non-orbiting scroll member 18 has a plurality of embossments 30 which are adapted to be attached to bearing housing 22 by a plurality of bolts 32.

Orbiting scroll member 20 is comprised of an end plate 34 and a spiral wrap 36 which extends upright from end plate 34 into chamber 26. Spiral wrap 36 is meshed with spiral wrap 28 of non-orbiting scroll member 18 in the usual manner to form in combination with bearing housing 22, compressor section 14 of fluid machine 10. A plurality of closed chambers 52 are defined by the meshing of wraps 28 and 36 and the arrangement is in communication with a usual discharge port 54 formed in the central position of non-orbiting scroll member 18. Discharge port 54 communicates with a discharge chamber 56 formed by separation plate 19 and upper cap 15.

Bearing housing 22 has a plurality of radially outwardly extending lobes 38 affixed to hermetic shell assembly 12. Lobes 38 of bearing housing 22 align with embossments 30 of non-orbiting scroll member 18 and have a plurality of threaded holes 40 for accepting bolts 32 to attach non-orbiting scroll member 18 for limited axial movement as described above.

Compressor section 14 further includes a crankshaft 46 having an eccentric shaft portion 48 coupled to orbiting scroll member 20 through a drive bushing and bearing assembly 50. Crankshaft 46 is supported at its lower end by a lower bearing assembly 64 and crankshaft 46 includes an upper counterweight 60 and a lower counterweight 62. Lower bearing assembly 64 is fixedly secured to hermetic shell assembly 12 and has a center portion 66 having an elongated bore 68 in which is disposed a journal bearing 70 which is designed to receive the lower end of crankshaft 46.

Motor drive section 16 is comprised of a motor stator 80 securely mounted in lower shell 13, preferably by press fitting, and a motor rotor 82 coupled to crankshaft 46 of compressor section 14.

An IPR valve 84 is directly secured to separation plate 19 by resistance welding. While the preferred embodiment shown in FIGS. 1 and 2 illustrates valve 84 being directly secured to separation plate 19 by resistance welding, for exemplary purposes, it is to be understood that other types of securing methods including but not limited to capacitive discharge welding or brazing could be employed if desired.

IPR valve 84, best shown in FIG. 2, comprises a housing 86, a check ball 88, a piston 90, a return spring 92 and a reaction disc 94. In order to facilitate the welding of housing 86 of IPR valve 84 to plate 19, a weld bead 96 is formed on housing 86 of IPR valve 84 on the end of housing 86 being secured to plate 19. An annular extension 98 extends from housing 86 of IPR valve 84 into a passage 100 extending through plate 19. Annular extension 98 operates to position and guide valve 84 during the welding operation. Housing 86 further defines an internal bore 102 which is open to passage 100 and bore 102 extends through housing 86 to define a ball seat 104. In its normally closed position, check ball 88 is seated against ball seat 104 of housing 86 and against a second ball seat 106 located on piston 90. Check ball 88 and piston 90 are held in the closed position by return spring 92 which reacts against disc 94. Valve 84 is assembled by placing check ball 88, piston 90, return spring 92 and reaction disc 94 into bore 102. The open end of bore 102 is then rolled over or crimped at 108 to retain these components within bore 102. The assembled IPR valve 84 is then directly secured to separation plate 19 by welding or brazing. The pressure at which valve 84 will release discharge pressure from discharge chamber 56 to suction pressure in suction chamber 21 will be determined by the size of ball seat 104 and the load being applied by return spring 92.

Figure 3:
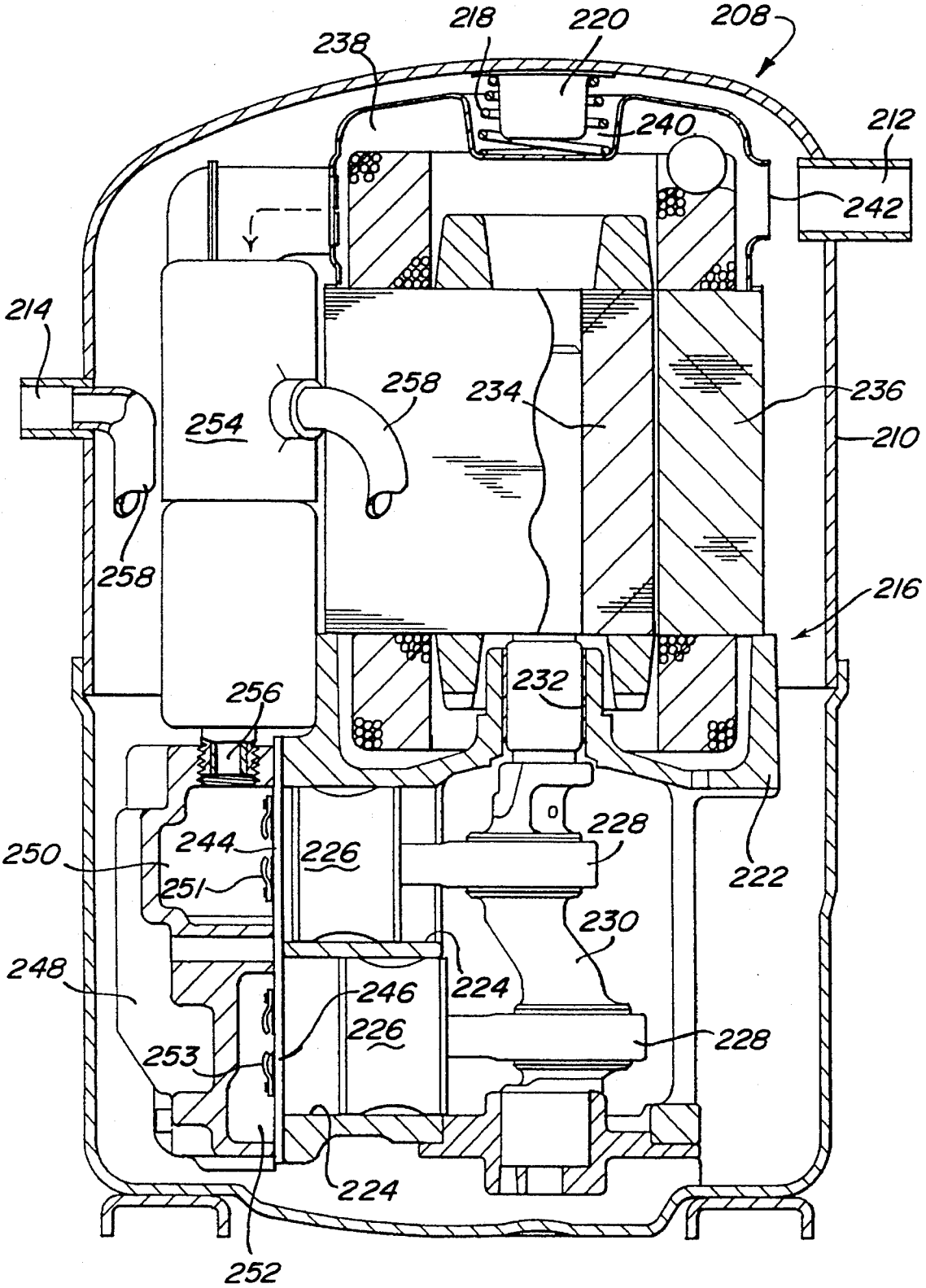
FIG. 3 is a side elevation, partially in cross section, of a hermetically sealed piston/cylinder compressor in accordance with the present invention.
Figure 4:
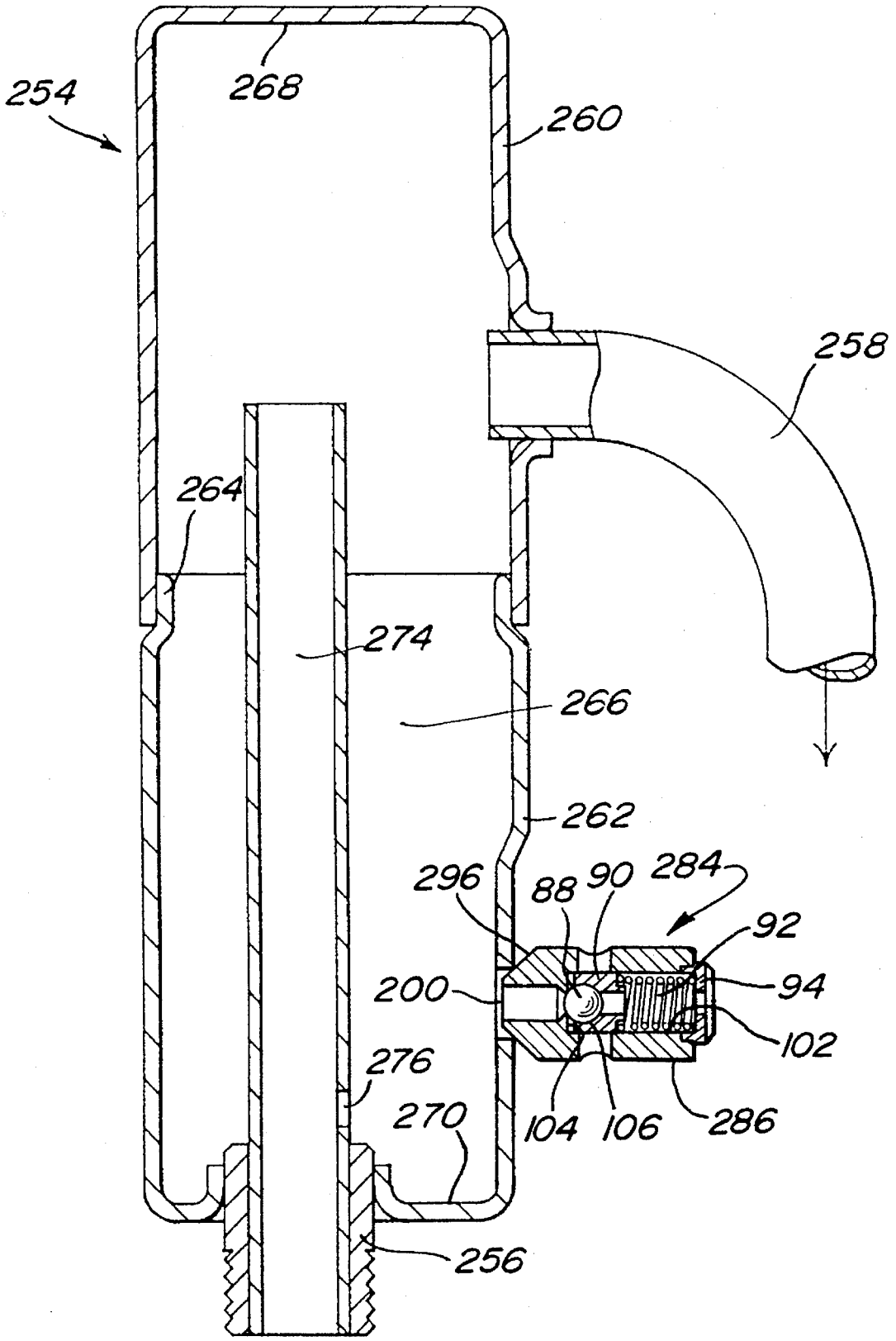
FIG. 4 is an enlarged view, partially in cross section, of the discharge muffler assembly shown in FIG. 3 illustrating the attachment of the IPR valve.

Referring now to FIGS. 3 and 4, another embodiment of the present invention is illustrated for exemplary purposes embodied in a two cylinder reciprocating compressor 208. The major components of compressor 208 include a hermetic shell 210, a suction gas inlet fitting 212, a discharge gas outlet fitting 214, and a motor-compressor unit 216 disposed therein and spring supported in the usual manner (not shown) and positioned at the upper end by means of a spring 218 located on a sheet metal projection 220. The motor compressor unit 216 generally comprises a compressor body 222 defining a plurality of pumping cylinders 224 (two parallel radially disposed cylinders in this case), in each of which is disposed a reciprocating pumping member in the form of a piston 226 connected in the usual manner by connecting rod 228 to a crankshaft 230 rotationally journalled in a bearing 232 disposed in body 222. The upper end of crankshaft 232 is affixed to a motor rotor 234 rotatively disposed within a motor stator 236, the upper end of which is provided with a motor cover 238 which has a recess 240 receiving spring 218 and an inlet opening 242 positioned to receive suction gas entering through fitting 212 for purposes of motor cooling prior to induction into the compressor. Each cylinder 224 in body 222 is opened to an outer planar surface 244 on body 222 to which is bolted the usual valve plate assembly 246 and cylinder head 248, all in the usual manner. Cylinder head 248 defines interconnected discharge gas chambers 250 and 252 which receive the discharge gas pumped by the compressor through discharge valve assemblies 251 and 253 respectively. Up to this point the compressor as described is known in the art and the essential details thereof are disclosed in the assignee's U.S. Pat. No. 4,412,791 the disclosure of which is hereby incorporated therein by reference.

The novelty in the present invention resides in the design of the discharge gas muffler 254, which is threadably affixed to head 248 in a sealing relationship by means of a fitting 256. Discharge gas exits muffler 254 via a tube 258 which winds its way through the space between motor-compressor 216 and shell 210 in the usual manner with the downstream end thereof being sealingly affixed to discharge fitting 214 which extends through shell 210 to connect the compressor to the system being supplied refrigerant under pressure.

Muffler 254 can be constructed as best shown in FIG. 4, comprising two relatively rigid stamped sheet metal cup members 260 and 262 telescoped and brazed together at 264 to define an elongated chamber 266 of generally circular cross-section for stiffness and having relatively flat parallel end walls 268 and 270 for sound wave stability.

Muffler 254 also comprises an impedance tube 274 disposed within chamber 266 and sealingly connected at one end to fitting 256 and being open at the opposite end. Impedance tube 274 is preferably straight and parallel to the longitudinal axis of chamber 266 and generally centrally located therein.

IPR valve 284 is directly secured to muffler 254 by resistance welding. For exemplary purposes, FIG. 4 illustrates IPR valve 284 being directly secured to cup member 262 of muffler 254 although it is within the scope of the present invention to have IPR valve 284 secured to cup member 260 of muffler 254 if required to meet specific packaging requirements. While the preferred embodiment is showing IPR valve 284 being directly secured to muffler 254 by resistance welding for exemplary purposes, it is to be understood that other types of securing methods including but not limited to capacitive discharge welding or brazing could be employed if desired.

IPR valve 284 is similar to IPR valve 84 with the exception being that housing 86 is replaced by a housing 286. In order to facilitate the welding of housing 286 of IPR valve 284 to muffler 254, a chamfered surface 296 is formed on housing 286 of IPR valve 284 on the end of housing 286 being secured to muffler 254. Chamfered surface 296 extends into a passage 200 extending through cup member 262 of muffler 254. The extension of chamfered surface 293 into passage 200 operates to position and guide valve 284 during the welding operation.

IPR valve 284 of compressor 208 functions identical to IPR valve 84 of compressor 10. When discharge pressure within discharge muffler 254 exceeds a predetermined value, ball 88 is forced off of seat 104 and gas at discharge pressure is released to the interior of hermetic shell 210.

While IPR valve 84 has been illustrated and described as being directly secured to plate 19 and IPR valve 284 has been illustrated and described as being directly secured to muffler 254, IPR valve 84 and IPR valve 284 are interchangeable thus allowing IPR valve 284 and IPR valve 284 to be directly secured to a plate 19 and IPR valve 84 to be directly secured to muffler 254 if desired.

While the above detailed description describes the preferred embodiment of the present invention, it should be understood that the present invention is susceptible to modification, variation and alteration without deviating from the scope and fair meaning of the subjoined claims.

What is claimed is:

1. A hermetic fluid compressor comprising:

a hermetic shell having a fluid port opening through a wall of said shell;

a discharge member positioned within said shell and separating a suction pressure zone from a discharge pressure zone, said discharge member having a pressure relief passage extending between said discharge pressure zone and said suction pressure zone; and a pressure relief member located within said suction pressure zone and secured directly to said discharge member by a weld, said pressure relief member being in communication with said pressure relief passage.

2. The hermetic fluid compressor as claimed in claim 1 wherein said discharge member has a centrally disposed discharge port.

3. The hermetic fluid compressor as claimed in claim 1 wherein said discharge member at least partially defines a high pressure chamber.

4. The hermetic fluid compressor as claimed in claim 1 wherein said discharge member at least partially defines a suction chamber.

5. The hermetic fluid compressor as claimed in claim 1 wherein said pressure relief member is an internal pressure relief valve including an elongated single piece body welded to said discharge member.

6. The hermetic fluid compressor as claimed in claim 5 wherein said single piece body includes a welding surface and a ball seat.

7. The hermetic fluid compressor as claimed in claim 5 wherein said single piece body includes an annular extension positionable within said pressure relief passage.

8. The hermetic fluid compressor as claimed in claim 5 wherein said pressure relief valve further includes a pressure responsive mechanism disposed within said body and operable to direct high fluid pressure to a low pressure side of the hermetic shell.

9. A scroll compressor comprising:

a shell having an inlet port and an outlet port through a wall thereof;

a first scroll member affixed to said shell and a second scroll member orbiting relative to said first scroll member;

a plate located within said shell said plate separating a suction pressure zone from a discharge pressure zone, said plate being disposed adjacent to one of said scroll members; and a pressure relief valve located within said suction pressure zone, said pressure relief valve being welded directly to said plate.

10. The scroll compressor as claimed in claim 9 wherein said pressure relief valve is positioned on a low pressure side of said plate.

11. The scroll compressor as claimed in claim 9 wherein said pressure relief valve is positioned between said plate and one of said scroll members.

12. The scroll compressor as claimed in claim 9 wherein said plate includes a centrally positioned discharge port and a pressure relief passage spaced radially from said centrally positioned discharge port.

13. The scroll compressor as claimed in claim 12 wherein said valve includes an annular extension positioned within said pressure relief passage.

14. The scroll compressor as claimed in claim 12 wherein said pressure relief valve is located approximate to said pressure relief passage, said pressure relief valve being welded about its periphery to said plate to create a seal.

15. The scroll compressor as claimed in claim 7 further comprising a cover, said cover and said plate being operable to define a discharge chamber.

16. The scroll compressor as claimed in claim 9 wherein said pressure relief valve includes a mechanism operable to direct sensed pressurized fluid to a low pressure side of said compressor.

17. The scroll compressor as claimed in claim 9 wherein said pressure relief valve comprises:

a single piece body having a weld surface and a central cavity which defines a ball seat, said single piece body being welded to said plate;

a ball adjacent said ball seat;

a spring for biasing said ball against said ball seat;

a piston positioned between said spring and said ball; and a spring retainer disc located at an end of the central cavity opposite to said ball seat.

18. A method of assembling a hermetic compressor comprising:

providing a hermetic compressor shell, a discharge member and a pressure responsive valve said discharge member separating a discharge pressure zone from a suction pressure zone;

welding said pressure responsive valve directly to said discharge member; and fixing said discharge member within said shell such that said pressure responsive valve is located within said suction pressure zone.

19. The method of assembly as claimed in claim 18 further comprising the step of providing a cover and affixing said cover to said discharge member after said pressure valve is welded to said discharge member.

* * * * *